US006940946B2

(12) United States Patent
Kutschera

(10) Patent No.: US 6,940,946 B2
(45) Date of Patent: Sep. 6, 2005

(54) ROTATING ANODE WITH A MULTI-PART ANODE BODY OF COMPOSITE FIBER MATERIAL, AND METHOD FOR MAKING SAME

(75) Inventor: Wolfgang Kutschera, Aurachtal (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 10/774,258

(22) Filed: Feb. 6, 2004

(65) Prior Publication Data

US 2004/0218722 A1 Nov. 4, 2004

(30) Foreign Application Priority Data

Feb. 6, 2003 (DE) ..... 103 04 936

(51) Int. Cl.[7] ..... H01J 35/10
(52) U.S. Cl. ..... 378/130; 378/144
(58) Field of Search ..... 378/125, 127, 378/128, 130, 143, 144

(56) References Cited

U.S. PATENT DOCUMENTS 3,735,175 A * 5/1973 Blomgren, Jr. ..... 378/127
5,943,389 A 8/1999 Lee ..... 378/144
6,430,264 B1 * 8/2002 Lee ..... 378/144
2004/0013234 A1 * 1/2004 Kutschera ..... 378/144

FOREIGN PATENT DOCUMENTS

DE 199 26 741 1/2001
JP 61-22546 7/1984

* cited by examiner

*Primary Examiner*—Edward J. Glick
*Assistant Examiner*—Courtney Thomas
(74) *Attorney, Agent, or Firm*—Schiff Hardin LLP

(57) ABSTRACT

A rotating anode for an x-ray tube has an anode body composed of composite fiber material, mounted in a bearing system, the anode body having a target surface with a focal ring and including fibers with particularly high heat conductivity in the longitudinal direction. An axis-proximal cooling system is associated with the anode body. The majority of all fibers with high heat conductivity in the longitudinal direction terminate bluntly both at the focal ring and at the cooling system, such that their abutting faces respectively are in direct, heat-conducting contact both with the focal ring and with the cooling system.

11 Claims, 7 Drawing Sheets

ROTATING ANODE WITH A MULTI-PART ANODE BODY OF COMPOSITE FIBER MATERIAL, AND METHOD FOR MAKING SAME

BACKGROUND OF THE INVENTION

1. Field of the Invention

The present invention concerns a rotating anode for an x-ray tube of the type having an anode body composed of composite fiber material, mounted in a bearing system, that has a target surface with a focal ring and fibers with particularly high heat conductivity, with an axis-proximal cooling system associated with the anode body. The present invention also concerns a method producing such a rotating anode.

2. Description of the Prior Art

X-ray tubes with rotating anodes are known from Krestel, "Bildgebende Systeme für die medizinische Diagnostik", pages 157f, in which the anode plate is composed of a molybdenum alloy. An x-ray-active cover layer made of a tungsten-rhenium alloy is applied to the base body. A graphite body is mounted under the anode plate for heat storage, dissipation and radiation, such that the anode plate is formed of a composite of Mo and C substrate, produced with solder technology, in which the heat spreads (radiates) corresponding to the heat conductivities and the heat storage properties. The WRe alloy of the cover layer can possess a thickness of 0.6 to 1.6 mm.

In x-ray tubes, one of the substantial technical challenges is the heat removal from the focal spot and the distribution of the heat of the focal spot to larger surfaces by rotation of the anode, which is exposed to high mechanical stresses from the rotation and from thermo-mechanical loads. Furthermore, in particular for application in computed tomography (CT), the usually heavy anode weight is a disadvantage since, due to the typical centrifugal forces resulting in CT from the device rotation, high stressing of the rotating anode bearing results from the heavy anode weight, Therefore, in German patent application 102 29 069.5 a rotating anode with a basic body made of carbon fiber materials (CFC) is proposed in which fibers with particularly high heat conductivity effect an advantageous heat removal from the focal spot path of x-ray rotating anode tubes to an internally cooled bearing system.

A rotating anode for an x-ray tube, with an anode body composed of composite fiber material held mounted in a bearing system is known from U.S. Pat. No. 5,943,389 having a target surface with a focal ring and fibers with particularly high heat conductivity. An intermediate layer is applied to the anode body, on which a number of aligned carbon fibers are applied, on which in turn the focal ring is applied. The aligned carbon fibers serve to improve the heat removal from the focal ring into the anode body.

German OS 199 26 741 discloses a liquid-metal slide bearing with a cooling tube for a rotating anode, whereby the cooling medium flowing through the slide bearing absorbs and transports away the heat incidental in the operation of the x-ray tube, that arrives in the slide bearing from the anode.

In the abstract for JP 6 1022 546, a method is described to produce a rotating anode that is fashioned from formed components of composite fiber material, known as "prepregs."

In such known x-ray rotating anodes, the problem of achieving good heat conductivity still exists.

SUMMARY OF THE INVENTION

An object of the present Invention is to design a rotating anode for an x-ray tube of the type initially described, as well as to specify as a production method for such a rotating anode, such that the high temperatures ensuing in the target surface (fashioned as a rotating anode) are directed away from the focal ring more rapidly than in known anodes so that the anode withstands the thermo-mechanical load for a longer time, or alternatively sustains higher power densities given unprolonged exposure times, The object is inventively achieved in a rotating anode of the type initially described wherein a majority of the totality of fibers that exhibit particularly high heat conductivity in the longitudinal direction terminate bluntly, both at the focal ring and at the cooling system, such that their abutting faces are in direct, heat-conducting contact both with the focal ring and with the cooling system, so that better dissipation is ensured. Such a CFC basic body can be produced such that the fibers therein optimally transfer the heat to an axis-proximal cooling surface without geometrically expanding the dimensions that are typical today for x-ray tubes.

More than 80% of the fibers with high heat conductivity in the longitudinal direction, particularly advantageously substantially all of these fibers, inventively terminate bluntly both at the focal ring and at the cooling system.

With regard to the use of the high longitudinal heat conductivity, it has proven to be advantageous when the anode body is fashioned as a multipart body, meaning that it is formed of two or more parts, with the individual parts attached to one another with an accurate fitting, such that the inner surface of an external part completely contacts the outer surface of an internal part. The anode body can be inventively formed from three parts.

A simpler assembly results when each part of the anode body exhibits an identically sized bore through which the cooling system is placed.

The above object is inventively achieved in a production method for a rotating anode having the steps of creation of at least two cup-shaped or bell-shaped formed components, of which the outer diameter of a smaller of the formed components corresponds to the inner diameter of a larger of the formed components, production of concentric bores of the same diameter d in each of the formed components, combining the formed components by resting within each other and interconnection of the formed components, and connection of the finished body to the cooling system.

The interconnection of the formed components and/or the connection of the finished body to the cooling system inventively can ensue in the framework of the overall assembly, for example by carbonization or by soldering.

DESCRIPTION OF THE PREFERRED EMBODIMENTS

Figure 1:
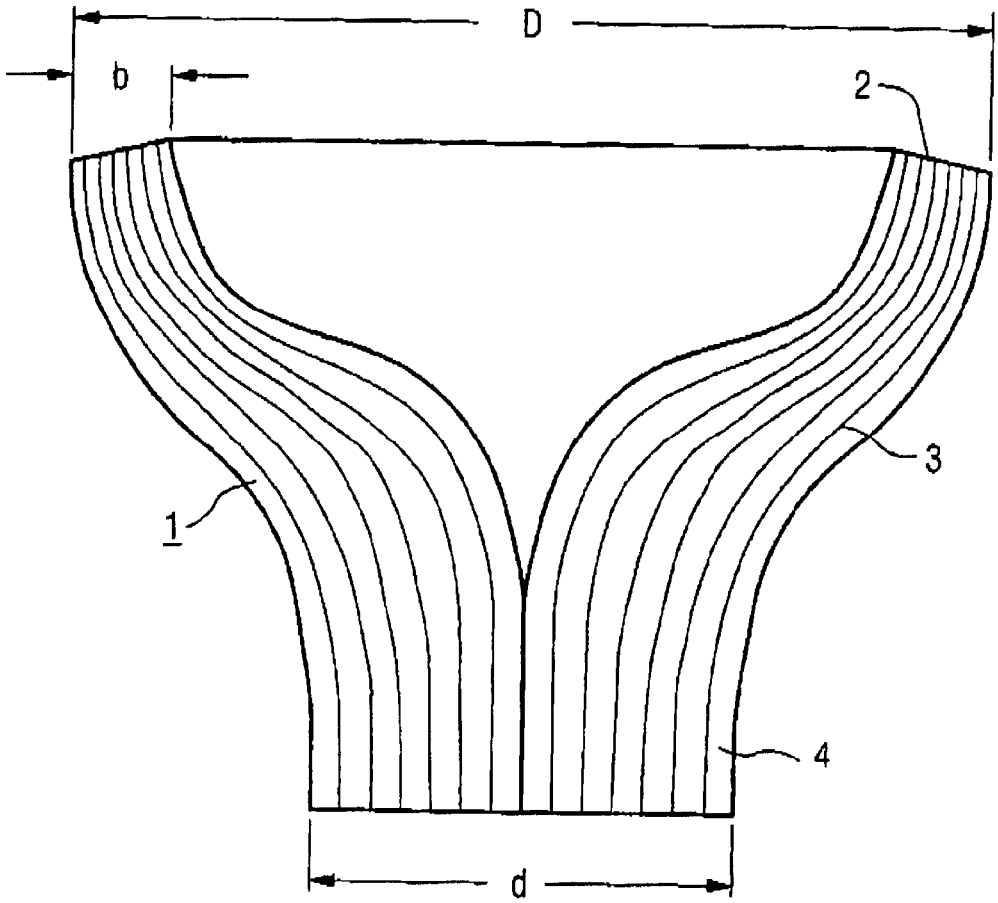
FIG. 1 illustrates a blank of known anode body.
Figure 2:
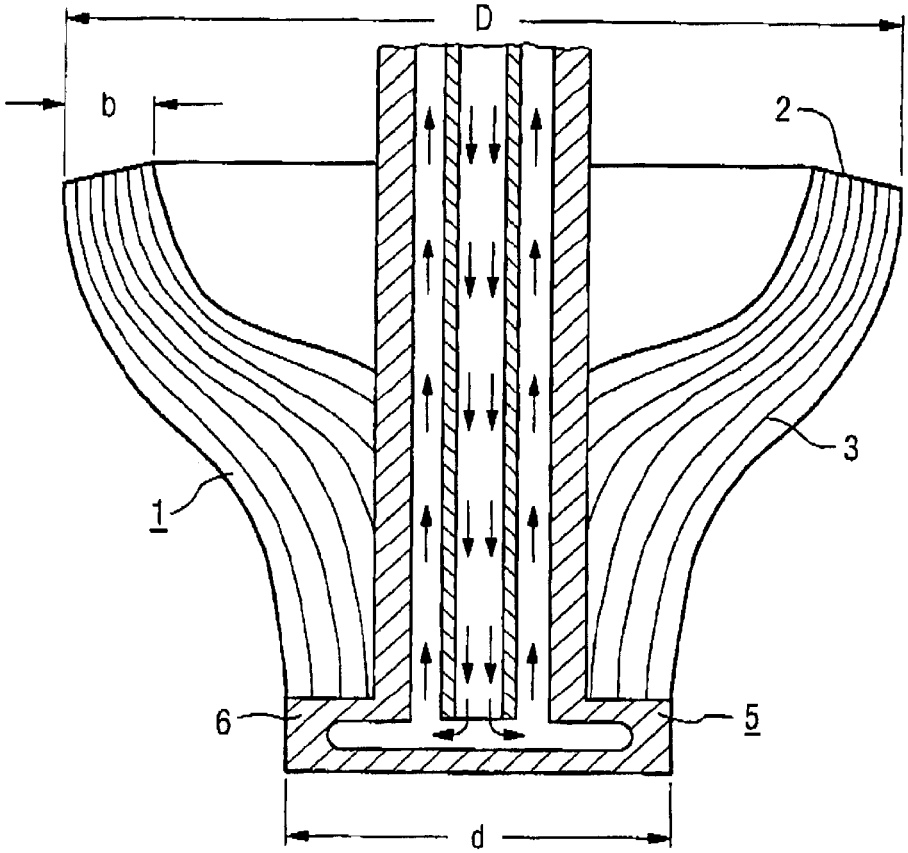
FIG. 2 illustrates a processed rotating anode with the anode body of FIG. 1 and a cooling body.

An obvious approach to fashioning a CFC body for a rotating anode is to cause the fibers to terminate on one end at the focal path and to terminate on the other end at the axis-proximal cooling body, as it is described using FIGS. 1 and 2.

In FIG. 1, a blank of an anode body 1 with a focal spot path 2 is shown that is composed of a composite fiber material, for example of a carbon fiber material (CFC) that has heat-conducting fibers 3 with particularly high heat conductivity in the longitudinal direction. The cup-like anode body 1 narrows and tapers in a shaft 4. The anode body 1 exhibits an external diameter D, the focal spot path 2 exhibits a width b, and the shaft 4 exhibits a thickness d.

A processed formed component of a rotating anode with a cooling arrangement is shown in FIG. 2 that was generated from a blank. For this, a bore was produced in the center of the anode body 1, through which a cooled bearing system 5 was placed and attached. In the anode body 1, fibers 3 are aligned such that they dissipate heat from the focal spot path 2 applied at an angle in the outer region of the rotating anode above to the cooled bearing system 5. So that all fibers 3 are in contact with the cooled bearing system 5, even the fibers 3 proceeding parallel to the rotation axis, the bearing system 5 must be provided with a flange 6 that exhibits the width b.

If it is desired that all fibers that begin under the focal path end at the cooling surface, and thus optimally use the excellent heat conductivity of the fibers in the lengthwise direction, then the diameter d of the flange 6 is determined from the focal path outer diameter D and the focal path width b as follows, due to the cross-section constant of the total amount of the fibers:

$$\left(\frac{D}{2}\right)^2-\left(\frac{D}{2}-b\right)^2=\left(\frac{d}{2}\right)^2 \quad \text{or}$$

$$d=\sqrt{Db-b^2}$$

For prevalent focal path geometries in the high-power tube range with a diameter of D=200 mm and a focal path width of b=15 mm, the flange diameter d must be relatively large, and that is difficult to realize in conventional tube design, Thus, the example cited above yields a flange diameter of d=105 mm.

For this reason, in accordance with the invention the anode body 3 is composed of multiple parts, as this is described for three parts using the following Figures.

Figure 3:
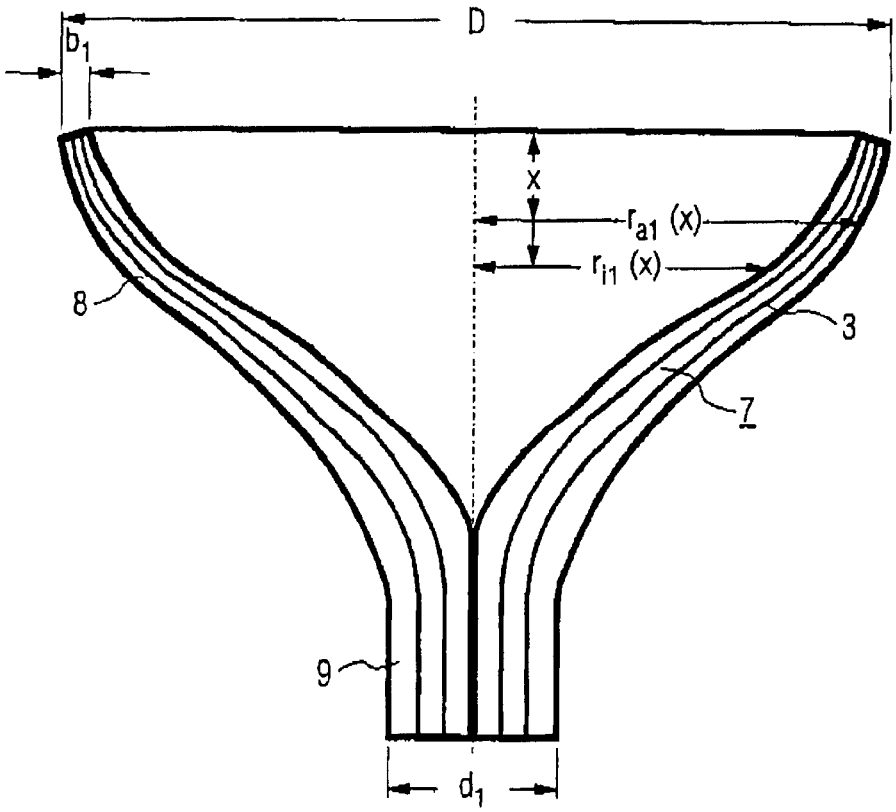
FIG. 3 shows a first blank for an anode in accordance with the invention.

In FIG. 3, a first blank is shown that exhibits an outer diameter D and a focal spot path exhibiting a width of $b_1$. The blank 7 is formed as a first shell-shaped portion 8 and a shaft-like portion 9 with a diameter $d_1$. The inner wall of the shell-shaped part 8 exhibits a shape that corresponds to the curve $r_{i1}(x)$, whereby x is the distance of the curve from the upper edge of the blank 7. The outer wall follows the freely-determinable function $r_{a1}(x)$ that determines the outer contour of the anode body.

Figure 4:
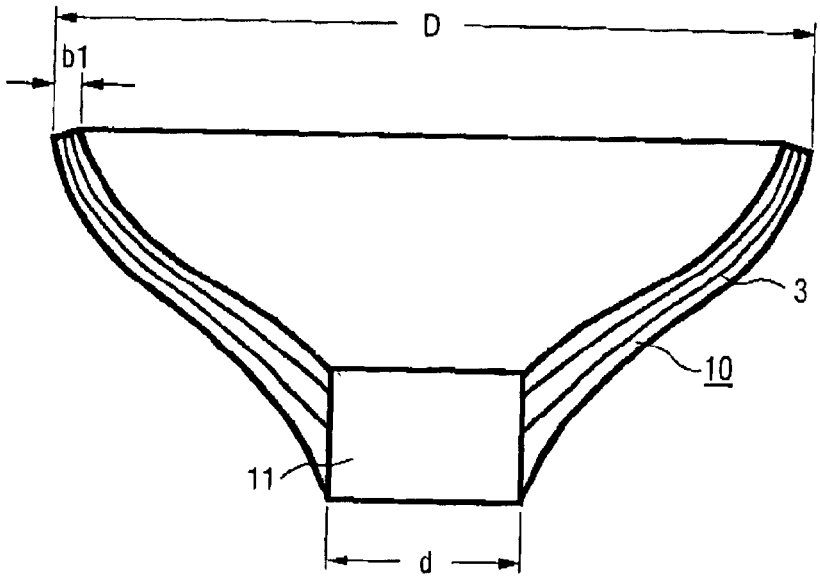
FIG. 4 shows a first processed formed component for an anode in accordance with the invention.

In order to arrive at the first processed formed component 10 shown In FIG. 4 from the blank 7, the shaft-like portion 9 is removed, by producing a bore 11 with a diameter d.

Figure 5:
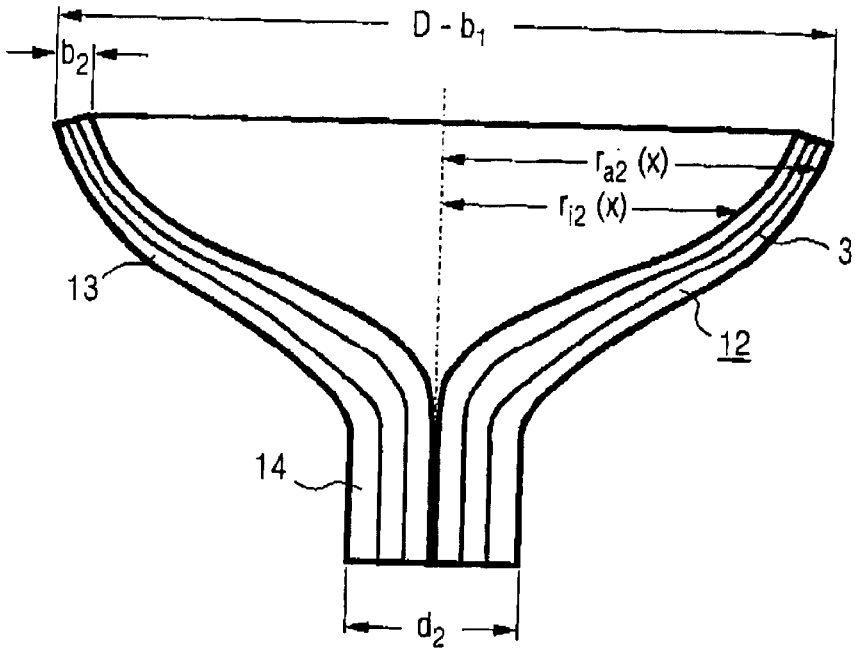
FIG. 5 shows a second blank for an anode in accordance with the invention.

In FIG. 5, a second blank 12 with a diameter $D-b_1$ and a focal spot path with a width $b_2$ are shown. The second blank 12 is also formed with a shell-shaped portion 13 and a shaft-like portion 14 with a diameter $d_2$. The shape of the outer wall of the shell-shaped portion 13 functionally corresponds to the shape of the inner wall of the part 10.

Figure 6:
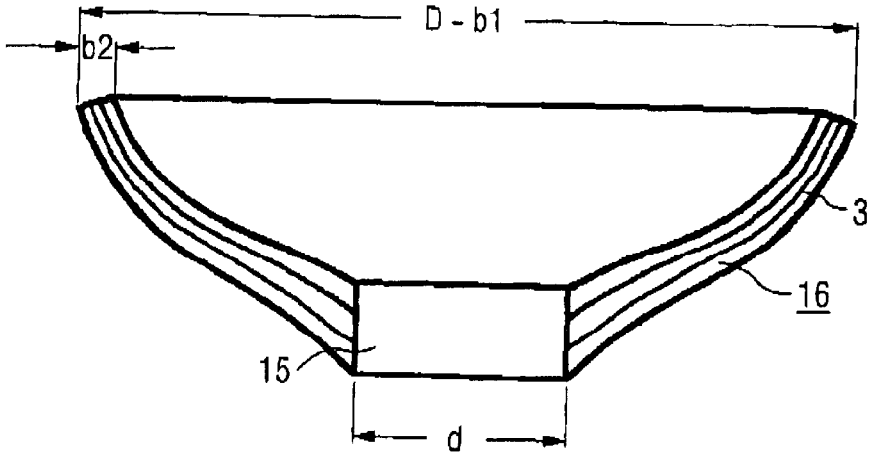
FIG. 6 shows a second processed formed component for an anode in accordance with the invention.

The second processed formed component 16 shown in FIG. 6 is arrived at from the second blank 12 by producing a bore 15 with the diameter d, whereby the portion 14 is removed.

Figure 7:
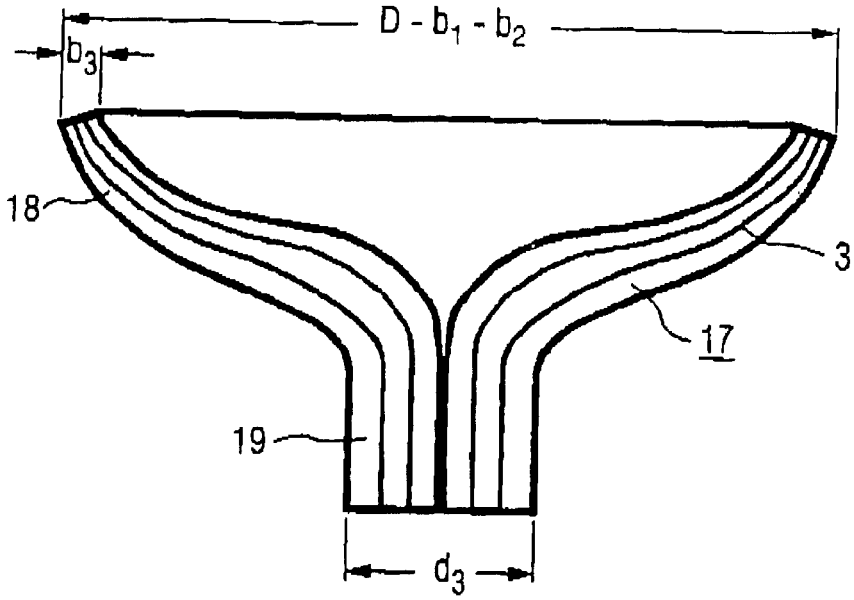
FIG. 7 shows a third blank for an anode in accordance with the invention.

A third blank 17 with an external diameter $D-b_1-b_2$ and a focal path surface with a width $b_3$ is shown in FIG. 7. The third blank 17 is also fashioned shell-like in the upper portion 18 and has a shaft-like portion 19 with a diameter $d_3$.

Figure 8:
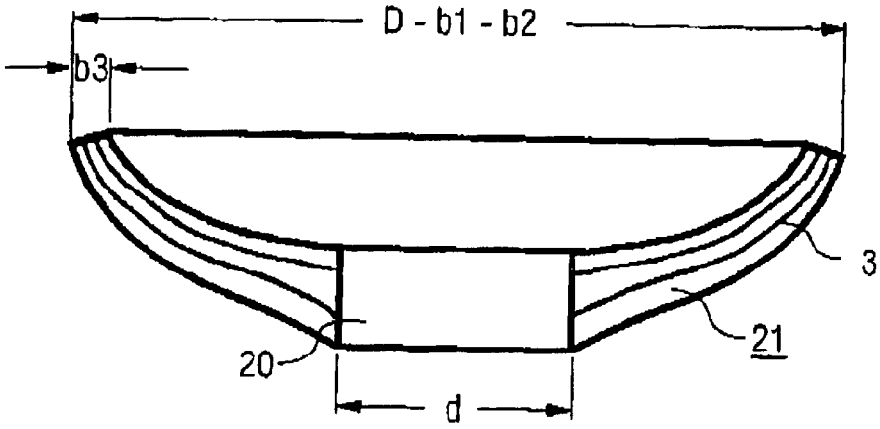
FIG. 8 shows a third processed formed component for an anode in accordance with the invention.

By introducing a bore 20 with a diameter d, at the processed third formed component 21 shown in FIG. 8 is produced from the third blank 17, whereby the portion 19 is removed. The shape of the outer wall of this third formed component 21 corresponds to the shape of the inner wall of the second formed component 16.

Figure 9:
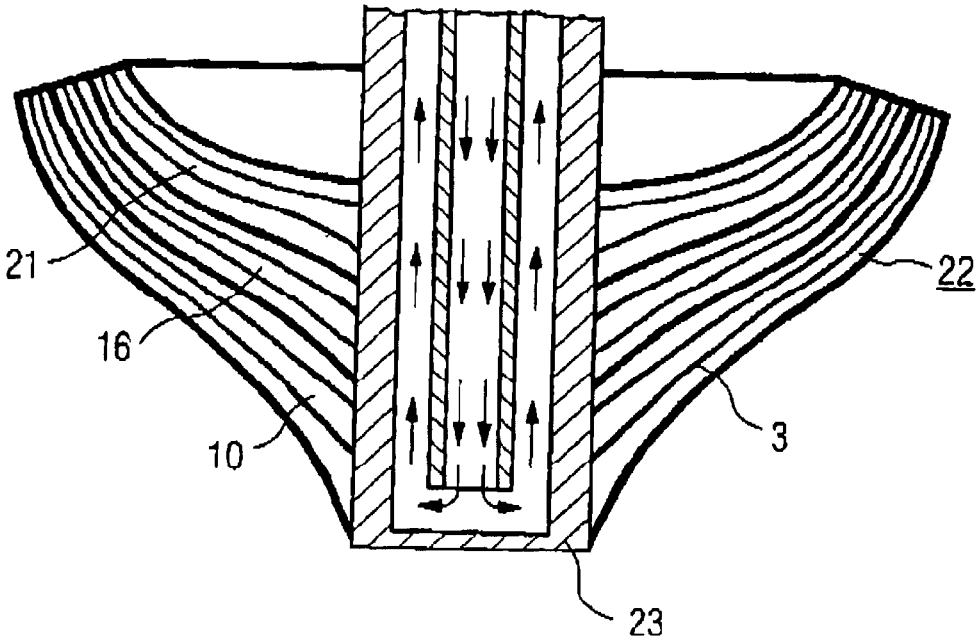
FIG. 9 shows a rotating anode with joined, processed formed components and a cooling body in accordance with the invention.

The three formed components 10, 16 and 21 are now combined and connected with one another, such that a coherent CFC base body 22 results that is shown in FIG. 9.

The interconnection of the n mechanically processed formed components can ensue in the framework of a solidification method, for example vy carbonization or via soldering. The connection of the finished body to the cooling surface can be implemented likewise.

A cooling body 23 (that, in the installed state, has a coolant flowing through it), at the surface of which all heat-conducting fibers terminates is slid through the single bore arising in the CFC base body 22, such that the heat is dissipated directly from the focal spot path 2 to the metallic cooling body 23.

As is already described, the CFC base body 22 is composed of n (in this example n=3) different formed components, in order to be able to use such a rotating anode in tubes of conventional design, The shaping of the blanks 7, 12 and 17 is undertaken such that these fit into one another after the axial, concentric bores 11, 15 and 20 with the diameter d are produced, without the mutual fitting surfaces themselves having to be appreciably processed. Fibers would be split by processing of the fitting surfaces, and the optimal heat flow thus hindered. Such an advantageous shaping of the blanks 7, 12 and 17 is possible by appropriate design of the mold lining from which the blanks are formed (set, knit, woven, prefiled, etc.), If, for example, the desired outer contour of the anode base body is given by $r_{a1}(x)$, whereby $r_{a1}(x) \geqq d$, then the outer contour of the mold lining for the outermost of the n formed components 10 is specified by $$(r_i(x))^2 \approx (r_a(x))^2-(Db-b^2)\sqrt{1+(r_{a'(x)})^2},$$

whereby the pitch of the fibers in the shell-shaped region between the focal path and the shaft is accounted for by the term under the root.

This inner contour (specified by $r_{i1}(x)$) of the outermost formed component 10, that is identical to the outer contour of that mold lining on which the outermost formed component was formed, is, for $r_{i1}(x)>d$, at the same time the new outer contour $r_{a2}(x)$ for the second formed component 16, the mold lining for which in this region can then be calculated analogously to the first mold lining.

In the region $r_{a2}(x)<d$, the outer contour of the second formed component 16 is largely freely determinable. It is only to be noted that it must be possible to accommodate the total fiber cross-section of the second formed component 16 within $r_{a2}$.

The calculations for the further formed components ensue analogously.

So that real solutions to the equations are obtained, it is necessary, as already stated, for the outer contour values always to be selected such that the total fiber cross-section of the respective formed component can always be accommodated within rotating anode. This can be ensured by appropriate selection of the values for b. In other words: the diameter of the outer contour may never be so small that the circular area corresponding to it is smaller than the total cross-section of the fibers of the respective formed component.

The desired geometry of the formed component thus can be easily calculated according to the principle of the cross-section constant of the entirety of the fibers and by suitable selection of the values $b_1$ through $b_n$, and can be adjusted to desired values for d when either the outer or the inner contour of the anode base body is determined.

This procedure is possible both a) given use of blanks that are composed only of a loose fiber composite, whereby in this case suitable clampings are selected for mechanical processing of the blanks, and b) given blanks that are already partially or are ultimately impregnated, reinforced, infiltrated, reaction-infiltrated, pyrolized, carbonized or graphited.

The space requirement at the cooling body can be significantly reduced by the inventive device and method. With optimal utilization of the high axial heat conductivities of all carbon fibers beginning in the focal path, geometries are possible that correspond to the tube designs that are common today, thus resulting in, for example, a diameter of d=62 mm given a diameter of D=200 mm and a width of the individual focal spot paths of $b_1=b_2=b_3=5$ mm. A retrofitting of anodes with CFC base bodies in conventional tubes thus is also possible with optimal utilization of the high axial heat conductivity of the C-fibers.

In the figures, for clarity only the temperature-conducting fibers 3 are shown. Fibers proceeding in other directions, such as those specified in the patent application Ser. No. 102 29 069.5, naturally can be provided, however are not of fundamental importance for the present invention.

Although modifications and changes may be suggested by those skilled in the art, it is the intention of the inventor to embody within the patent warranted hereon all changes and modifications as reasonably and properly come within the scope of his contribution to the art.

I claim as my invention:

1. A rotating anode for an x-ray tube comprising:

an anode body composed of composite fiber material, including fibers having a preferred heat conductivity in a longitudinal fiber direction, and having a target surface with a focal ring, said anode body having an axis around which said anode body is rotatable;

a cooling system aligned with said axis, said anode body having a surface facing said cooling system and thermally interacting with said cooling system, and a majority of the fibers having said preferred heat conductivity in the longitudinal direction having opposite end faces that terminate bluntly at said focal ring and at said surface, with the respective end faces in direct, heat-conducting, abutting contact with said focal ring and with said cooling system.

2. A rotating anode as claimed in claim 1 wherein more than 80% of the fibers having said preferred heat conductivity in the longitudinal direction terminate bluntly at said focal ring and at said cooling system.

3. A rotating anode as claimed in claim 1 wherein substantially all of the fibers having said preferred heat conductivity in the longitudinal direction terminate bluntly at said focal ring and at said cooling system.

4. A rotating anode as claimed in claim 1 wherein said anode body is composed of multiple parts, each part comprising a formed component and said formed components being combined with respective accurate fits to each other to form said anode body, with each component that is external to an adjacent internal component having an inner surface that completely contacts an outer surface of said internal component.

5. A rotating anode as claimed in claim 4 wherein said anode body consists of three of said formed components.

6. A rotating anode as claimed in claim 4 wherein each of said formed components has a centrally-disposed bore therein, the respective bores being of identical size and being concentrically disposed when said formed components are combined in said anode body, said cooling system being disposed in said bores.

7. A rotating anode as claimed in claim 4 wherein each of said formed components has a focal ring having a width, the respective widths of the focal rings being substantially identical.

8. A method for producing a rotating anode for an x-ray tube comprising the steps of:

producing a plurality of shell-shaped formed components respectively of different sizes and similar geometric shapes for nesting within each other with an outer diameter of a smaller of said formed components corresponding to an inner diameter of a larger of said formed components;

producing a centrally disposed bore in each of said formed components, the respective bores having substantially identical diameters;

combining said formed components by nesting to form an anode body with said bores concentrically aligned; and disposing a cooling system in the anode body in the bores of said formed components.

9. A method as claimed in claim 8 comprising combining said formed components in a solidification procedure.

10. A method as claimed in claim 9 comprising connecting said cooling system in said solidification procedure.

11. A method as claimed in claim 9 comprising employing a solidification procedure selected from the group consisting of carbonization and soldering.

* * * * *